US006775474B2

(12) United States Patent
Desloge

(10) Patent No.: US 6,775,474 B2
(45) Date of Patent: Aug. 10, 2004

(54) HEAT TRANSFER SYSTEM WITHOUT A ROTATING SEAL

(75) Inventor: George B. Desloge, Town & Country, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 43 days.

(21) Appl. No.: 10/136,214

(22) Filed: May 1, 2002

(65) Prior Publication Data

US 2003/0206734 A1 Nov. 6, 2003

(51) Int. Cl.[7] ..... F24H 1/00
(52) U.S. Cl. ..... 392/488; 392/485; 165/61
(58) Field of Search ..... 392/449, 451, 392/485, 488; 165/61

(56) References Cited

U.S. PATENT DOCUMENTS

| | | | | |
|---|---|---|---|---|
| 1,965,218 A | | 7/1934 | Carr | |
| 2,711,473 A | * | 6/1955 | Mahaffy et al. | 137/341 |
| 3,153,382 A | | 10/1964 | Van Blarcom, Jr. | |
| 3,318,253 A | | 5/1967 | Campolong | |
| 3,333,544 A | | 8/1967 | Turk | |
| 3,630,645 A | | 12/1971 | Eheim | |
| 3,746,472 A | | 7/1973 | Rupp | |
| 3,897,178 A | | 7/1975 | Palloch | |
| 4,129,178 A | * | 12/1978 | Hucke | 165/61 |
| 4,198,191 A | | 4/1980 | Pierce | |
| 4,516,915 A | | 5/1985 | Jensen et al. | |
| 4,699,573 A | | 10/1987 | Petrie et al. | |
| 4,856,971 A | * | 8/1989 | Koble, Jr. | 417/423.8 |
| 5,293,446 A | * | 3/1994 | Owens et al. | 392/449 |
| 5,864,941 A | | 2/1999 | Baichoo et al. | |
| 5,930,852 A | | 8/1999 | Gravatt et al. | |
| 6,203,294 B1 | | 3/2001 | Turley et al. | |

* cited by examiner

*Primary Examiner*—Thor Campbell
(74) *Attorney, Agent, or Firm*—Ari M. Bai; Greensfelder, Hemker & Gale, P.C.

(57) ABSTRACT

A fluid heat transfer system including a motor and a tank located in adjacent compartments. The motor includes a rotatable shaft extending into the tank having an opposed end connected to an impeller for circulating a heated working fluid through the system. A hollow tube surrounding the rotatable shaft extends from the motor into the tank and forms a leak proof seal between the tube and the tank so that the fluid will not leak outside of the tank. The fluid circulates through numerous tubes positioned within the tank having respective inside surfaces which are each provided with a heating unit therein for collectively heating fluid as the fluid passes between each respective inside surface and heating unit. The tubes have dimples formed therein for more efficiently heating the fluid.

37 Claims, 4 Drawing Sheets

HEAT TRANSFER SYSTEM WITHOUT A ROTATING SEAL

BACKGROUND OF THE INVENTION

1. Field of the Invention

The present invention relates to a heat transfer system, and more particularly to a fluid heat transfer system. More specifically, the present invention relates to a fluid tight multi-compartment fluid heat transfer system for pumping and circulating a heated working fluid therein.

2. Known Art

Prior art heat transfer systems that utilize motors to drive impellers to circulate a heated working fluid usually comprise several distinct and physically separate compartments with the motor residing in one compartment and the impeller in another separate compartment. The impeller is usually located in a tank containing a heated working fluid that circulates throughout the heat transfer system. A drive shaft is provided that operatively connects the motor to the impeller that extends through the walls of each compartment. To secure the shaft, rotating seals are mounted in the compartment walls. The motor and impeller are separated to protect the motor from the extremely hot working fluid being circulated through the other parts of the heat transfer system.

One disadvantage of multi-compartment heat transfer systems are that leaks of hot working fluid may develop outside of the rotating seals securing the drive shaft. Typically, these rotating seals are comprised of an opening formed in the compartment wall to receive the drive shaft having a layer of ceramic material applied to the surface of the opening. The drive shaft may also have a ceramic layer applied along a portion of the surface that rotates within the compartment wall opening. As the drive shaft rotates with respect to the opening, the impeller forces hot working fluid through the heat transfer system by raising the pressure of the fluid. Exposing the rotating seal to pressurized fluid invariably results in leakage of the hot working fluid from the compartment housing. Not only is the leakage inevitable, it is necessary as this leakage acts as a lubricant between the drive shaft and compartment wall opening surfaces. However, this leakage of hot working fluid can cause damage to areas surrounding the system and can create a dangerous situation.

Additionally, because of the inability to isolate heat from the working fluid and the motor in prior art systems, these systems are only capable of maintaining working fluid at or below a temperature of 600° F. Finally, these types of prior art systems are quite large and expensive to produce. Therefore, there appears a need in the art for a multi-compartment heat transfer system that uses hot working fluid without the inherent disadvantages of the prior art devices.

OBJECTS AND SUMMARY OF THE INVENTION

Among the several objects, features and advantages of the present invention is to provide a multi-compartment heat transfer system that circulates a heated working fluid without leaking.

Another feature of the present invention is to provide a heat transfer system that can maintain a heated working fluid at extremely high temperature levels.

A further feature of the present invention is to provide a heat transfer system of compact construction.

An additional feature of the present invention is to provide a heat transfer system that creates a balanced operating load for the impeller.

Yet a further feature of the present invention is to provide a heat transfer system having dimpled surfaces for improved heating efficiency.

Yet another further feature of the present invention is to provide a heat transfer system having a guiding region secured within the tank that rotatably carries the impeller such that working fluid may leak between the impeller and the guiding region without leaking from the heat transfer system.

These and other objects of the present invention are realized in the preferred embodiment of the present invention, described by way of example and not by way of limitation, which provides for a fluid heat transfer system having a novel motor and fluid heating tank arrangement.

In brief summary, the present invention overcomes and substantially alleviates the deficiencies in the prior art by providing a fluid heat transfer system comprising a tank having an inlet and an outlet for pumping and circulating a fluid therethrough with the tank further defining a guiding region for receiving a rotatable shaft. The rotatable shaft operatively associates with a motor at one end, while the other opposed end is a free end. A hollow tube surrounds the rotatable shaft with the shaft and tube extending into the tank. The opposed free end of the rotatable shaft is connected to an impeller For circulating the fluid. The impeller is rotatably carried by the guiding region within the tank so that the fluid may flow between the impeller and the guiding region without leaking outside of the tank.

Additional objects, advantages and novel features of the invention will be set forth in the description which follows, and will become apparent to those skilled in the art upon examination of the following more detailed description and drawings in which like elements of the invention are similarly numbered throughout.

BRIEF DESCRIPTION OF THE DRAWINGS

Corresponding reference characters identify corresponding elements throughout the several views of the drawings.

DESCRIPTION OF PRACTICAL EMBODIMENTS

Figure 1:
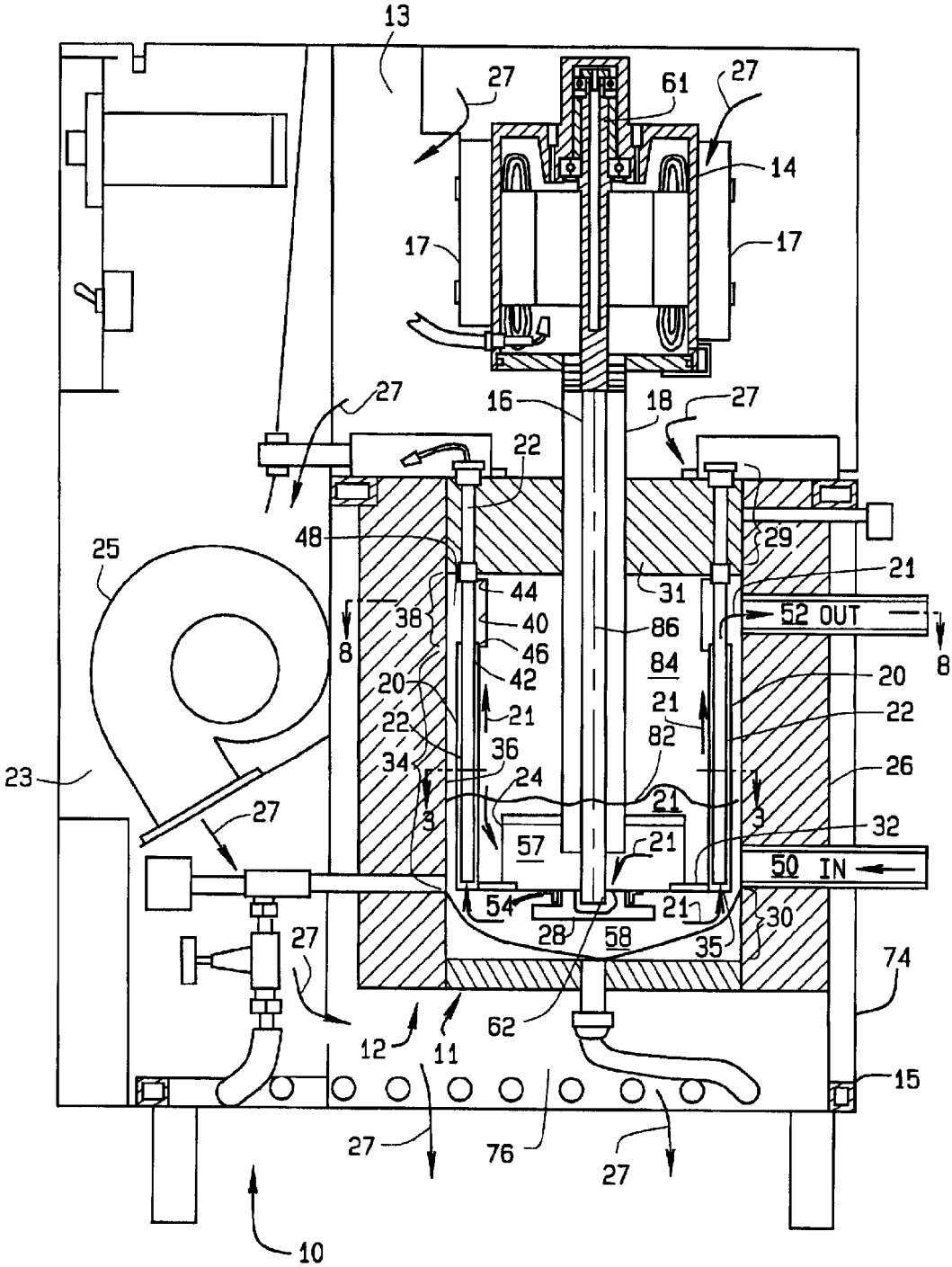
FIG. 1 is a cutaway side view of a fluid heat transfer system according to the present invention.

Referring to the drawings the preferred embodiment of the fluid heat transfer system of the present invention is illustrated and generally indicated as 10 in FIG. 1. Fluid heating system 10 comprises a frame 15 capable of supporting multiple compartments, including a tank compartment 11 having a tank 12 for circulating and heating a working fluid 21 therein. A motor compartment 13 is formed adjacent tank compartment 11 for mounting a motor 14 therein. As further shown, a drive shaft 16 extends from motor 14 to tank 12. Drive shaft 16 includes one end 61 operatively associated with motor 14 and an opposed end 62 attached to an impeller 28 for circulating fluid 21 throughout system 10. An outer tube 18 surrounds drive shaft 16 for substantially its entire length and forms a fluid tight seal between outer tube 18 and tank 12 such that no fluid 21 leaks between tank compartment 11 and motor compartment 13 as shall be explained in greater detail below.

Figure 2:
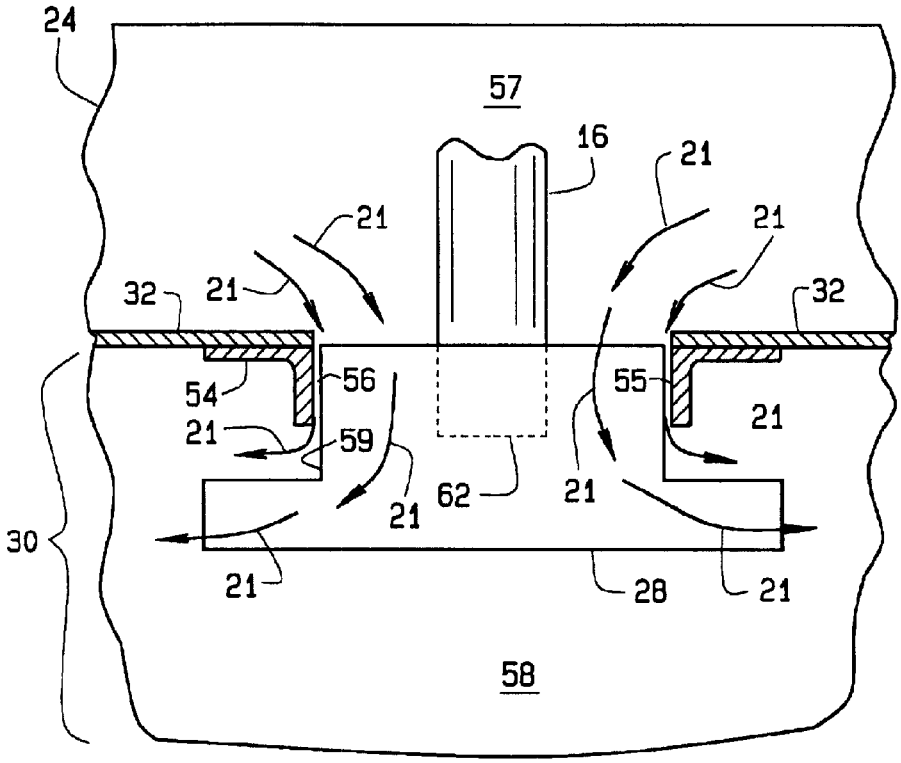
FIG. 2 is an enlarged cutaway side view of an impeller of the fluid heat transfer system according to the present invention.

As shown, tank 12 comprises a lower portion 30 which is separated from a middle portion 34 by a floor 32. Middle portion 34 of tank 12 extends into a manifold 38 that mixes fluid 21 heated in middle portion 34, while lower portion 30 defines a bowl shaped region for receiving fluid 21 from middle portion 34. Referring to FIG. 2, a flanged bushing 54 is connected to floor 32, preferably centrally located, for rotatably receiving impeller 28. A sleeve portion 55 which defines the inside diameter of flanged bushing 54 establishes a guiding region 56 for rotatably carrying impeller 28 along the outside diameter of its cylindrical base portion 59. However, the inside diameter of the guiding region 56 is larger than the corresponding outside diameter of base portion 59 such that fluid 21 may freely flow between the impeller 28 and guiding region 56. The flow of fluid 21 between the respective surfaces of guiding region 56 and impeller 28 provides lubrication and reduces wear due to sliding friction between these surfaces generated when drive shaft 16 drives impeller 28 into rotational movement. As shown back in FIG. 1, a plurality of apertures 35 are formed along the outer periphery of floor 32 in alignment with a plurality of fluid tubes 20 connected thereto so that each fluid tube 20 is in fluid flow communication with lower portion 30. Preferably, fluid tubes 20 are positioned symmetrically with respect to longitudinal axis 86 of drive shaft 16.

Preferably, a filtering device 24 is centered over flanged bushing 54 for filtering fluid 21 in middle portion 34 of tank 12 prior to the fluid 21 reaching lower portion 30. Filtering device 24 forms a leak proof seal with both floor 32 and outer tube 18 so that even if a fluid level 82 of fluid 21 is maintained above filtering device 24, fluid 21 cannot reach lower portion 30 without first passing through filtering device 24. To propel fluid 21 through filtering device 24, impeller 28 rotates about a longitudinal axis 86 along drive shaft 16 when driven by motor 14 such that a reduced pressure region 57 is created within filtering device 24. Fluid 21 propelled into lower portion 30 from reduced pressure region 57 creates a raised pressure region 58 therein that further propels fluid 21 throughout the remainder of the system 10. Due to the symmetric location of fluid tubes 20 with respect to axis 86, as well as the centered location of filtering device 24, the operating load applied to impeller 28 by fluid 21 is balanced which prolongs the service life of all associated components.

As further shown, middle portion 34 is formed adjacent lower portion 30 and is defined collectively by floor 32, heat baffle 29 and an inner wall 36. Inner wall 36 includes a thermally insulating layer 26 that surrounds fluid tubes 20. Middle portion 34 acts as a reservoir for fluid 21 that is depleted through filtering device 24 and replenished through an inlet 50 which communicates with the return line of system 10. Preferably, fluid level 82 is maintained relatively low within middle portion 34 so that the remaining portion of middle portion 34 defines an insulating region 84. Insulating region 84 is filled with a gas that is compatible with system 10 and reduces the amount of thermal energy generated by hot working fluid 21 and heating units 22 that must be dissipated from the top of tank 12. Further reducing the amount of required thermal energy dissipation, heat baffle 29 is comprised of numerous parallel plates 31, which act to insulate the top of tank 12. In other words, the parallel plates 31 of baffle 29 greatly reduce the amount of thermal energy that escapes from tank 12. This reduced thermal energy dissipation is accomplished by ambient air 27 that is circulated by a fan 25 which is critical for maintaining the temperature in motor compartment 11 below a level that prevents over heating of motor 14. Fins 17 extend radially outward from motor 14 and are in fluid communication with ambient air 27 to further dissipate thermal energy generated by motor 14.

Figure 3:
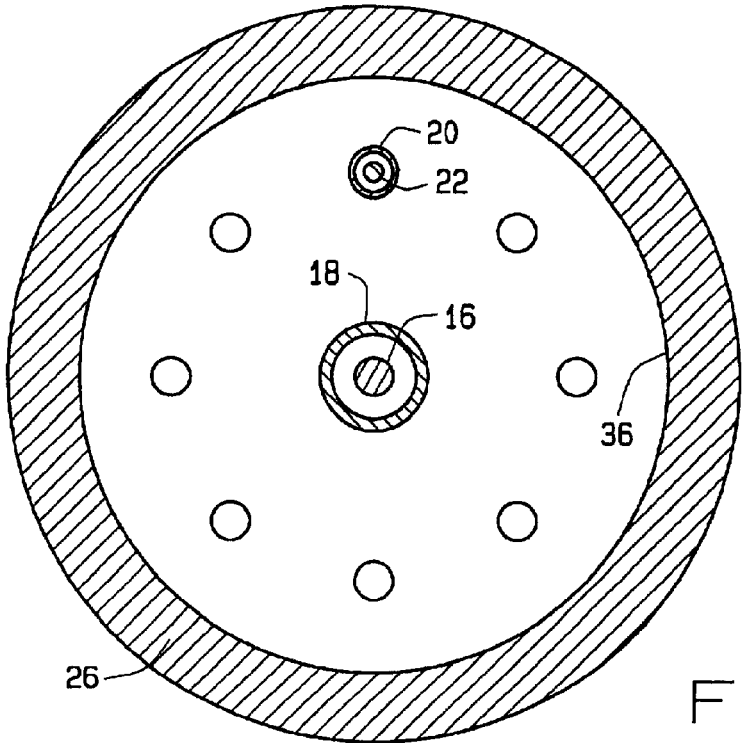
FIG. 3 is a cross-sectional view taken along line 3—3 of FIG. 1 of the fluid heat transfer system showing a tank according to the present invention.
Figure 4:
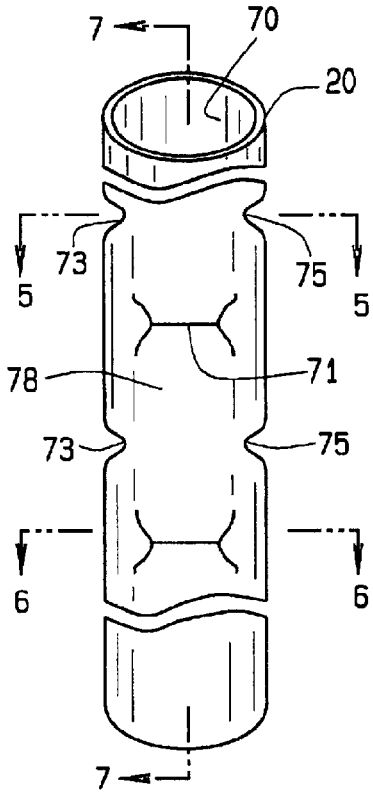
FIG. 4 is a partial cutaway perspective view of the fluid heat transfer system showing a dimpled tube arrangement according to the present invention.
Figure 5:
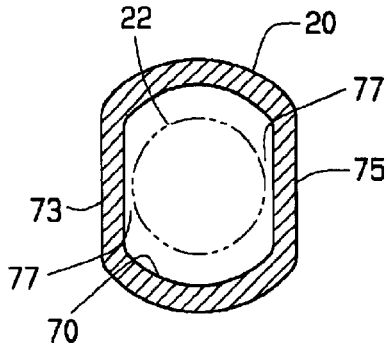
FIG. 5 is a cross-sectional view taken along line 5—5 of FIG. 4 of the dimpled tube according to the present invention.
Figure 7:
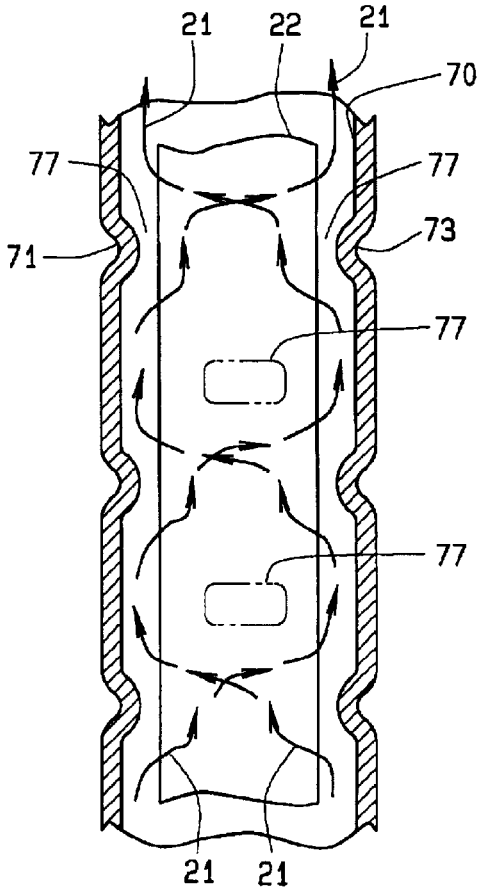
FIG. 7 is a cross-sectional view taken along line 7—7 of FIG. 4 of the dimpled tube showing flow of fluid therein according to the present invention.
Figure 6:
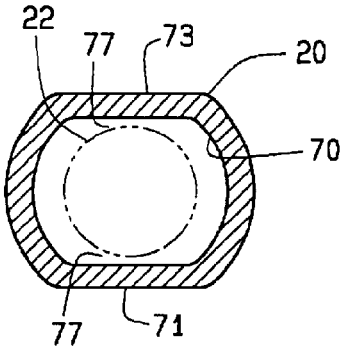
FIG. 6 is a cross-sectional view taken along line 6—6 of FIG. 4 of the dimpled tube according to the present invention.

Referring to FIGS. 1, 3 and 7, fluid tubes 20 direct fluid 21 from lower portion 30 to manifold 38. To heat fluid 21, a heating unit 22, preferably a conventional cartridge heater of cylindrical shape, is inserted inside each respective fluid tube 20. Heating unit 22 is comprised of any well known electroresistive composition that generates heat radially outward along its longitudinal length upon receiving electrical power from an electrical power source (not shown). By virtue of this arrangement, fluid 21 is heated as it passes along fluid tube 20 between inner surface 70 of fluid tube 20 and outer surface 80 of heating unit 22.

Referring to FIGS. 4–7, to further improve the efficiency of heating unit 22, opposing aligned left lateral and right lateral dimples 73, 75 are formed in fluid tube 20, preferably equidistantly spaced by a parallel set of V-shaped jaws (not shown). The V-shaped jaws are directed toward each other until lateral dimples 73, 75 have sufficiently deformed inside surface 70 to establish opposing reduced flow regions 77 that greatly reduce the distance between the heating unit 22 and the corresponding portion of inside surface 70 opposite lateral dimples 73, 75. Although deformed inside surface regions opposite lateral dimples 73, 75 do not physically contact heating unit 22 to permit selective installation and removal of heating unit 22, reduced flow regions 77 are of sufficient proximity to substantially redirect the flow of fluid 21 around reduced flow regions 77.

Interposed in fluid tube 20 between lateral dimples 73, 75 are aligned front and rear dimples 71, 72. Preferably, after forming lateral dimples 73, 75, fluid tube 20 is rotated ninety degrees about its center axis 78 prior to forming front and rear dimples 71, 72. Front and rear dimples 71, 72 are preferably spaced and formed in the same manner as lateral dimples 73, 75 and likewise establish reduced flow regions 77. As a result of the offset reduced flow regions 77, the flow of fluid 21 passing between fluid tube 20 and heating unit 22 is repeatedly forced to flow around the opposed reduced flow regions 77, thereby resulting in turbulent flow. Although the flow path of fluid 21 is shown proceeding in a crisscross manner, fluid 21 may also or additionally proceed in a coiled path about the heating unit 22. However, irrespective the actual path taken by fluid 21, flow is sufficiently disrupted so that the resulting turbulent flow greatly increases the ability of fluid 21 to remove thermal energy from heating unit 22. This increased ability of fluid 21 to remove heat energy thereby increases the efficiency of heat transfer system 10. Referring specifically to FIG. 3, fluid tubes 20 are positioned inside of inner wall 36 so that fluid tubes 20 also heat fluid 21 along middle portion 34.

Figure 8:
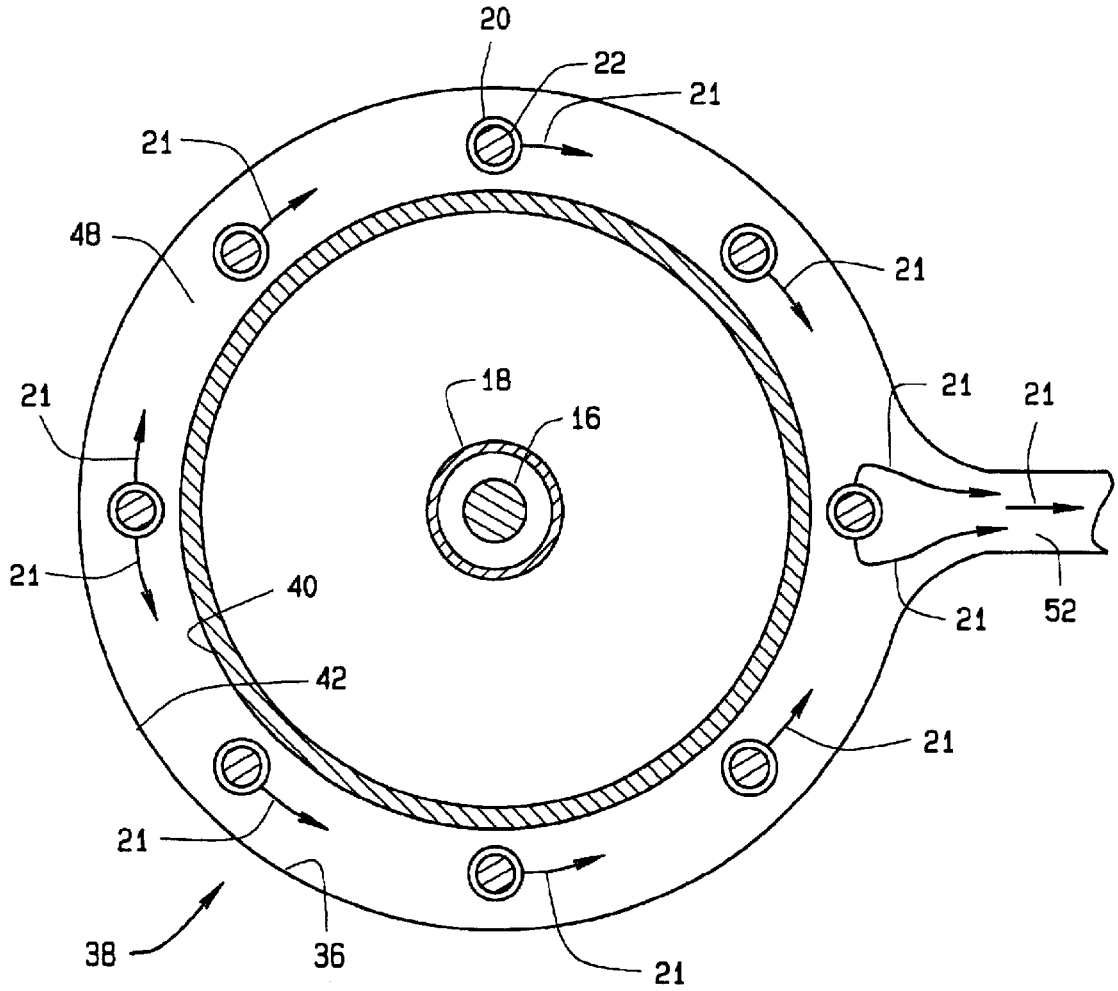
FIG. 8 is a cross-sectional view taken along line 8—8 of FIG. 1 of the tank used in the fluid heat transfer system showing a manifold according to the present invention.

Referring to FIGS. 1 and 8, fluid 21 proceeds through middle portion 34 along fluid tubes 20 before reaching manifold 38. Manifold 38 defines an annular region bounded by floor and ceiling portions 44, 46 and inner and outer walls 40, 36 and provides a mixing area 48 for fluid 21 prior to reaching outlet 52 for circulating fluid 21 throughout the remainder of system 10.

Referring back to FIG. 1, heat baffle 29 preferably comprises a plurality of spaced plates 31 which are positioned in association with tank 12 and preferably atop manifold 38. Heat baffle 29 helps insulate the top of tank 12 by reducing the amount of thermal energy generated by hot working fluid 21 and heating units 22 that reach motor compartment 13. Used in combination with a fan 25 that dissipates heat generated by heating units 22 and heated fluid 21 which reaches motor compartment 13, this extremely compact construction of heat transfer system 10 may maintain fluid 21 working temperatures to at least 1,200° F. While simultaneously maintaining fluid 21 working temperature at these elevated levels, thermal insulation provided by heat baffle 29 combined with heat dissipation in motor compartment 13 from fan 25 is sufficient to maintain the temperature below a level that would prevent damage to motor 14. In comparison, conventional prior art systems operate at or below 600° F.

Fan 25 which is of known construction is provided within a fan compartment 23 for circulating a high volume of ambient air 27 that acts to cool motor 14 in order to maintain fluid 21 at extremely high operating temperatures without overheating motor 14. Preferably, relatively cool ambient air enters through the top of motor compartment 13 for reducing motor 14 temperature before entering fan compartment 23. To further increase the cooling efficiency of ambient air 27, fins 17 extending from motor 14 assist to dissipate thermal energy generated by motor 14. As further illustrated, air 27 then passes through fan 25 and is subsequently directed downward through a bottom region 76 of frame 15 prior to exiting frame 15.

Referring to FIGS. 1–8, the operation of heat transfer system 10 shall now be discussed. Motor 14 urges drive shaft 16 in a forced rotational motion about its longitudinal axis 86 which also causes impeller 28 to rotate. Rotation of impeller 28 creates reduced pressure region 57 within filtering device 24 and causes fluid 21 located in middle portion 34 to flow through filtering device 24. Fluid 21 that has entered reduced pressure region 57 is then propelled by impeller 28 into lower portion 30 creating raised pressure region 58. The raised pressure in region 58 causes fluid 21 to be further propelled from lower portion 30 through apertures 35 and into fluid tubes 20. Fluid 21 is then propelled along fluid tubes 20 between outer surface 80 of heating unit 22 and inner surface 70 of fluid tubes 20. To heat fluid 21 passing through fluid tubes 20, heating units 22 generate heat radially outward from outer surface 80 along its longitudinal length. To further improve thermal efficiency of heating units 22, opposing left and right lateral dimples 73, 75 and opposing front and rear dimples 71, 72 are alternately formed in each fluid tube 20. Each opposing pair of dimples 71, 72 and 73, 75 establish opposing pairs of reduced flow regions 77 which disrupt fluid 21 passing between inner surface 70 of each fluid tube 20 and heating unit 22 to flow in a turbulent within fluid tube 20 which further heating of fluid 21.

Once fluid 21 passes through fluid tubes 20, it enters manifold 38 which defines mixing area 48 before fluid 21 is directed through outlet 52 and into the remaining portion of heat transfer system 10. After passing through the remaining portion of heat transfer system 10, fluid 21 returns to tank 12 through inlet 50, wherein the operation is repeated.

A number of compositions for fluid 21 may be used in system 10 so long as the composition is compatible with system 10 and the operating temperature is maintained below its boiling point. One such fluid composition that may be used at operating temperatures approaching 1,200° F. is sodium; however, other suitable fluid compositions exhibiting similar properties are felt to fall within the scope of the present invention.

One having skill in the art will appreciate that front and rear dimples 71, 72 and lateral dimples 73, 75 are not necessarily uniformly spaced or aligned at ninety degrees to each other as measured from center axis 78, or in an alternating sequence, so long as fluid 21 flows in a turbulent fashion.

The present invention contemplates a number of constructions for filtering device 24 including, but not limited to, sintered materials, screen, mesh, interwoven fibers, interwoven wires, porous material or other suitable constructions exhibiting similar properties.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A fluid heat transfer system comprising:

a tank having an inlet and an outlet in communication therebetween for circulating a fluid, said tank further having a guiding region; and a motor including a rotatable shaft extending therefrom having an opposed end, said rotatable shaft extending into said tank, said opposed end being connected to an impeller for circulating said fluid, said impeller being rotatably carried by said guiding region within said tank so that said fluid may flow between said impeller and said guiding region without leaking outside of said tank.

2. The fluid heat transfer system according to claim 1 further comprising a hollow tube surrounding said rotatable shaft for substantially the length of said rotatable shaft, said hollow tube extending into said tank.

3. The fluid heat transfer system according to claim 1 wherein said motor is located atop said tank.

4. The fluid heat transfer system according to claim 1 wherein said fluid flowing between said impeller and said guiding region provides lubricity therewith.

5. The fluid heat transfer system according to claim 1 wherein said guiding region comprises a flanged bushing.

6. The fluid heat transfer system according to claim 5 wherein said flanged bushing further defines a sleeve portion for rotatably carrying said impeller.

7. A fluid heat transfer system comprising:

a tank having an inlet and an outlet in communication therebetween for circulating a fluid inside said tank, said tank further having a guiding region;

a heat baffle associated with said tank for reducing the amount of thermal energy escaping from said tank;

a plurality of fluid tubes in communication with said inlet and said outlet, said fluid tubes each adapted to receive a respective heating unit therein for heating said fluid passing between said fluid tubes and said respective heating units; and a motor including a rotatable shaft extending therefrom having an opposed end, said rotatable shaft extending through said heat baffle and into said tank, said opposed end being connected to an impeller for circulating said fluid.

8. The fluid heat transfer system according to claim 7, wherein said impeller being rotatably carried by said guiding region within said tank so that said fluid may flow between said impeller and said guiding region without leaking outside of said tank.

9. The fluid heat transfer system according to claim 7 wherein said heat baffle is comprised of a plurality of parallel plates.

10. The fluid heat transfer system according to claim 7 wherein said heat baffle is located atop said tank.

11. The fluid heat transfer system according to claim 7 further comprising a hollow tube surrounding said rotatable shaft for substantially the length of said shaft, said hollow tube extending into said tank.

12. The fluid heat transfer system according to claim 7 wherein said fluid tubes are symmetrically spaced radially about said shaft so that the operating load applied to said impeller is balanced.

13. The fluid heat transfer system according to claim 7 further comprising a thermally insulative layer surrounding said fluid tubes.

14. The fluid heat transfer system according to claim 7 further comprising a filtering device located within said tank between said inlet and said outlet.

15. The fluid heat transfer system according to claim 7 wherein each said fluid tube has a plurality of dimples formed therein to increase thermal efficiency of said heating unit.

16. The fluid heat transfer system according to claim 7 further comprising a fan located outside of said tank, said fan in ventilating communication with said motor for dissipating heat generated by said fluid heat transfer system such that said motor does not over heat.

17. The fluid heat transfer system according to claim 7 further comprising a manifold defining a mixing region in communication with said fluid tubes.

18. The fluid heat transfer system according to claim 15 wherein each said fluid tube has a plurality of aligned first opposing dimples formed therein to increase the thermal efficiency of said heating unit.

19. The fluid heat transfer system according to claim 18 wherein each said fluid tube has a plurality of second opposing dimples formed therein to increase the thermal efficiency of said heating unit.

20. The fluid heat transfer system according to claim 19 wherein said first and second opposed dimples are alternately formed in each said fluid tube formed therein to increase the thermal efficiency of said heating unit.

21. The fluid heat transfer system according to claim 20 wherein said second opposed dimples are formed in each said fluid tube after rotating said fluid tube ninety degrees after forming said first opposed dimples in said fluid tube formed therein in order to increase the thermal efficiency of said heating unit.

22. The fluid heat transfer system according to claim 16 wherein said fan circulates ambient air for dissipating heat generated by said fluid heat transfer system to reduce said motor temperature.

23. The fluid heat transfer system according to claim 17 wherein said manifold defines an annular region.

24. A fluid heat transfer system comprising:

a tank having an inlet and an outlet in communication therebetween for circulating a fluid inside said tank;

a plurality of dimpled fluid tubes disposed between said inlet and said outlet, said fluid tubes each adapted to receive a plurality of heating units therein for heating said fluid passing between said fluid tubes and said heating units due to said dimpled fluid tubes causing said fluid to flow in a turbulent manner; and a motor including a rotatable shaft extending therefrom having an opposed end, said rotatable shaft being surrounded by a hollow tube for substantially the length of said shaft, said hollow tube and said shaft extending into said tank, said opposed end being connected to an impeller for circulating said fluid.

25. The fluid heat transfer system according to claim 24 wherein said heating unit is of electroresistive composition.

26. The fluid heat transfer system according to claim 24 wherein said heating unit is a cartridge heater.

27. The fluid heat transfer system according to claim 24 wherein said heating unit is cylindrically shaped.

28. The fluid heat transfer system according to claim 24 wherein said tank further comprises a guiding region for rotatably carrying said impeller.

29. The fluid heat transfer system according to claim 28 wherein said fluid may flow between said impeller and said guiding region without leaking outside of said tank.

30. The fluid heat transfer system according to claim 28 wherein said fluid flowing between said impeller and said guiding region provides lubricity therewith.

31. The fluid heat transfer system according to claim 28 wherein said guiding region comprises a flanged bushing.

32. The fluid heat transfer system according to claim 31 wherein said flanged bushing further defines a sleeve portion for rotatably carrying said impeller.

33. A fluid heat transfer system comprising:

a tank having an inlet and an outlet in communication therebetween for circulating a fluid, said tank further having a guiding region;

a filtering device located within said tank between said inlet and said outlet for filtering said fluid passing through said tank; and a motor including a rotatable shaft extending therefrom having an opposed end, said rotatable shaft extending into said tank, said opposed end being connected to an impeller for circulating said fluid, said impeller being rotatably carried by said guiding region within said tank so that said fluid may flow between said impeller and said guiding region without leaking outside of said tank.

34. The fluid heat transfer system according to claim 33 wherein said filtering device comprises a screen.

35. The fluid heat transfer system according to claim 33 wherein said filtering device defines a reduced pressure region for propelling said fluid through the fluid heat transfer system.

36. The fluid heat transfer system according to claim 34 wherein said filtering device is centered for balancing the operating load applied to said impeller by said fluid.

37. The fluid heat transfer system according to claim 36 further comprising a plurality of fluid tubes in communication with said inlet and said outlet, said fluid tubes each adapted to receive a respective heating unit therein for heating said fluid passing between said fluid tubes and said respective heating units, said fluid tubes being symmetrically positioned about said rotatable shaft for balancing the operating load applied to said impeller by said fluid.

* * * * *